United States Patent [19]

Algard

[11] 4,304,191

[45] Dec. 8, 1981

[54] STEERING DEVICE FOR SUBMARINES

[76] Inventor: Odd S. Algard, Algard, Norway, N-4330

[21] Appl. No.: 56,979

[22] Filed: Jul. 12, 1979

[51] Int. Cl.[3] ..... B63G 8/16; B63G 8/20

[52] U.S. Cl. ..... 114/338; 440/61

[58] Field of Search ..... 114/337, 338, 312, 330; 440/57, 61

[56] References Cited

U.S. PATENT DOCUMENTS

| | | | |
|---|---|---|---|
| 1,028,333 | 6/1912 | Desenberg et al. | 115/35 |
| 2,415,183 | 2/1947 | Law | 115/35 |
| 3,430,603 | 3/1969 | Parish | 115/35 |

FOREIGN PATENT DOCUMENTS

| | | | |
|---|---|---|---|
| 259941 | 4/1926 | Canada . | |
| 955032 | 12/1956 | Fed. Rep. of Germany | 115/35 |
| 1092794 | 11/1960 | Fed. Rep. of Germany | 114/330 |
| 1506775 | 7/1969 | Fed. Rep. of Germany | 114/330 |
| 103166 | 1/1917 | United Kingdom | 114/330 |

*Primary Examiner*—Sherman D. Basinger

*Attorney, Agent, or Firm*—Schwartz, Jeffery, Schwaab, Mack, Blumenthal & Koch

[57] ABSTRACT

A steering apparatus for a marine vessel comprising a propeller assembly connected to a driveshaft imparting power to the propeller through a joint on the shaft and further including hydraulic cylinders for permitting the angle of the propeller assembly to be varied in both the vertical and horizontal planes allowing the vessel to change direction.

2 Claims, 1 Drawing Figure

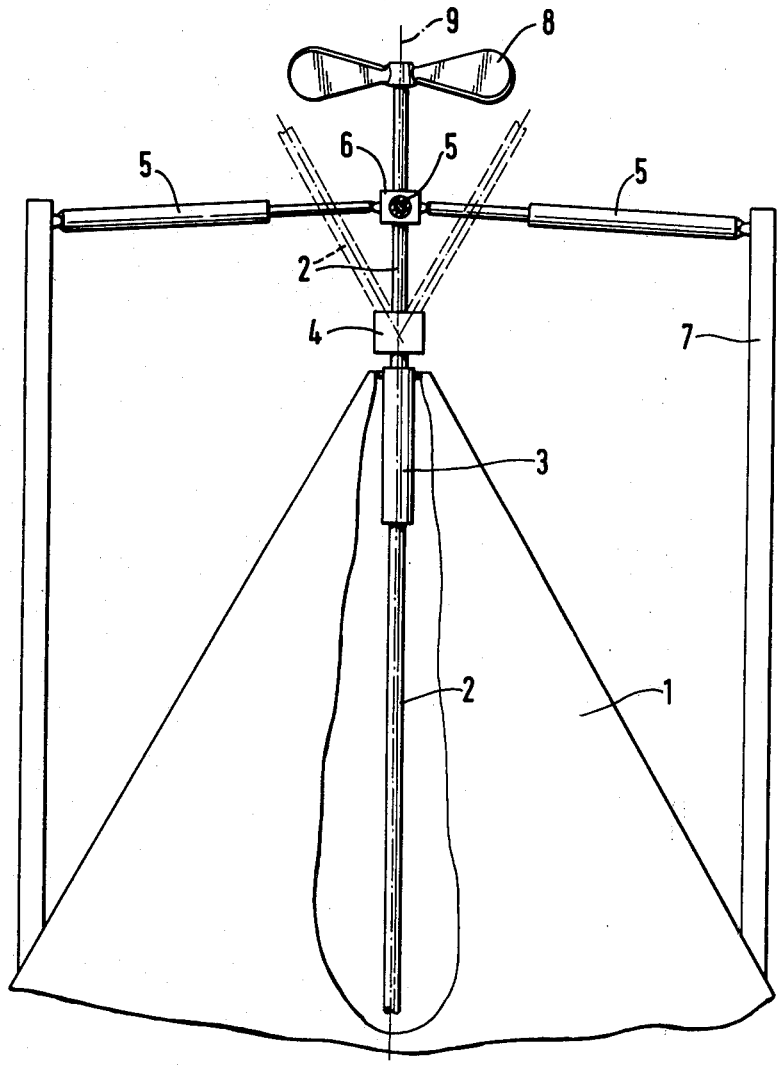
9
8
6
5
5
5
2
4
7
3
2
1

STEERING DEVICE FOR SUBMARINES

The present invention relates to a steering device for submarines.

The most common way of steering a submarine is by means of a conventional rudder, although it is also known to use the propeller for this purpose.

The present invention intends to provide a more effective mechanism for steering submarines than those already known.

According to the invention, the propeller shaft is provided with a universal joint situated immediately behind the point where the propeller shaft leaves its supporting sleeve. At a point behind said universal joint, four hydraulic cylinders are arranged in a crosswise fashion, each cylinder being secured at one end to a bearing through which the propeller shaft passes, and at the other end to the submarine's hull or an extension thereto. By means of these hydraulic cylinders arranged and secured in the fashion described above, the rearmost part of the propeller shaft may be positioned at any chosen angle in the horizontal and vertical planes relative to the submarine's longitudnal axis.

By positioning the rearmost part of the propeller shaft at an angle relative to the longitudinal axis of the submarine, the propulsion provided by the propeller causes the submarine to change its direction. This means of steering provides a more rapid response than when the submarine is caused to change direction by the resistance offered to the water by the rudder, and thus increases the submarine's manoeuvrability.

A preferred embodiment of the invention is shown on the accompanying drawing which schematically illustrates the invention as seen from above.

Referring to the drawing, the number 1 denotes the rear end of the submarine's hull, including the propeller shaft 2 and its supporting sleeve 3. Immediately behind said supporting sleeve 3 the propeller shaft 2 is provided with a universal joint 4. At a point behind the said universal joint 4 four hydraulic cylinders 5 are arranged in a crosswise fashion, each cylinder being secured at one end to a bearing 6 through which the propeller shaft 2 passes, and at the other end to an extension 7 from the submarine's hull. By means of the four hydraulic cylinders 5, the rearmost end of the propeller shaft 2 onto which the propeller 8 is mounted, may be positioned at any chosen angle in the horizontal and vertical planes relative to the submarine's longitudinal axis 9, as indicated by the broken lines.

What I claim is:

1. A steering apparatus for use on a submarine vessel comprising:

(a) a drive shaft;

(b) a propeller assembly secured to said drive shaft, said propeller assembly including a propeller;

(c) means for supporting said drive shaft;

(d) a universal joint connected between said propeller assembly and said drive shaft; and (e) a means for vertically and horizontally varying the angle of said propeller assembly relative to said drive shaft wherein said propeller assembly may be positioned at any angle in the vertical and horizontal planes relative to the drive shaft, said means for vertically and horizontally varying comprising: a bearing mounted to said propeller assembly between said propeller and said universal joint; two pair of hydraulic cylinders connected to said bearing; and means for mounting said hydraulic cylinders to said submarine vessel.

2. A steering apparatus as set forth in claim 1 wherein said means for mounting comprises a plurality of extensions extending rearwardly from the said submarine vessel, said hydraulic cylinders being connected between responsive ones of said extensions and said bearing.

* * * * *